US006149538A

United States Patent [19]

Tiura

[11] Patent Number: 6,149,538

[45] **Date of Patent: *Nov. 21, 2000**

[54] HANDLE FOR STRIKING DEVICE

[76] Inventor: Oliver Tiura, 50 Etta Wylie Road, Unit 503, Etobicoke, Ontario, Canada, M8V 3Z8

[ * ] Notice: This patent is subject to a terminal disclaimer.

[21] Appl. No.: 09/233,236

[22] Filed: Jan. 19, 1999

Related U.S. Application Data

[63] Continuation-in-part of application No. PCT/CA97/00519, Jul. 17, 1997, which is a continuation-in-part of application No. 08/684,360, Jul. 19, 1996, Pat. No. 5,669,835.

[51] Int. Cl.[7] ..... A63B 49/08

[52] U.S. Cl. ..... 473/550; 473/524; 473/549

[58] Field of Search ..... 473/550, 524, 473/549; 81/177.1, 3.4, 427.5, 58, 19, 20, 489

[56] References Cited

U.S. PATENT DOCUMENTS

| | | |
|---|---|---|
| 2,086,062 | 7/1937 | Bray . |
| 2,120,280 | 6/1938 | Hall . |
| 2,205,578 | 6/1940 | Schnur . |
| 3,489,031 | 1/1970 | Meier . |
| 4,082,276 | 4/1978 | Szafianski . |
| 4,108,436 | 8/1978 | Masi . |
| 4,139,195 | 2/1979 | Dressen et al. . |
| 4,174,109 | 11/1979 | Gaiser . |
| 4,407,500 | 10/1983 | Hofmann . |
| 4,907,810 | 3/1990 | Whiteford . |
| 5,018,733 | 5/1991 | Buand . |
| 5,131,652 | 7/1992 | Peng . |
| 5,269,516 | 12/1993 | Janes . |
| 5,374,059 | 12/1994 | Huang . |
| 5,397,123 | 3/1995 | Huang . |

FOREIGN PATENT DOCUMENTS

| | | |
|---|---|---|
| 2 569 567 | 3/1986 | France . |
| 2 596 994 | 10/1987 | France . |
| 28 19 174 A1 | 11/1979 | Germany . |
| 3225 481 | 1/1984 | Germany . |
| 34 13 600 | 8/1985 | Germany . |
| 36 25 929 A1 | 2/1988 | Germany . |
| 43 39 133 A1 | 7/1994 | Germany . |
| 1 510 626 | 5/1978 | United Kingdom . |
| WO 998/55270 | 5/1998 | WIPO . |

*Primary Examiner*—Jeanette Chapman
*Assistant Examiner*—V K Mendiratta
*Attorney, Agent, or Firm*—Young & Basile, P.C.

[57] ABSTRACT

A striking device handle for use in a variety of applications including ball game sports, or as a construction or demolition device handle used in construction, said device is intended to cool the user's hand and reduce the shock that occurs when a striking device impacts an object, the handle having a handgrip comprised of a central body having concavely curved front and rear surfaces which extend a substantial distance along the handgrip, and an exterior shell dispersed on opposite sides of the central body, covering the front and rear surfaces. The shell has a plurality of ventilation openings formed therein that communicate with two separate ventilation chambers that are formed between each of the front and rear surfaces and the shell. Two air inlets are formed on opposite sides of the handgrip at a head end, each air inlet opening into a respective one of the ventilation chambers at the head end. Each ventilation chamber is substantially deeper along a central longitudinal portion than along an end portion that is adjacent a butt end of the handgrip. In a preferred embodiment, the exterior shell of the handle is part of a single integral unit that includes the air intakes. The integral unit also forms a striking device head which can take the form of a racket head with strings attached, a paddle, a hatchet or axe head, a pick head, or a hammer head, such as a head with claws or a ball pein head.

29 Claims, 8 Drawing Sheets

HANDLE FOR STRIKING DEVICE

This application is a continuation-in-part of International Patent Cooperation Treaty application No. PCT/CA97/00519 filed on Jul. 19, 1997, and CIP of 08/684,360 Jul. 14, 1997 U.S. Pat. No. 5,669,835 issued on Sep. 23, 1999.

BACKGROUND OF THE INVENTION

The use of tennis, squash, racquetball, and paddle ball rackets or the ute of hand tools such as various types of hammers (claw, rip, finishing, ball pein, soft face, tack, brick, drywall, shingling, etc.), picks, various hatchets and axes, and other striking devices require substantial physical exertion of a user during the course of activity associated with the striking device. Frequently, this results in profuse perspiration, especially of the holding hand. As a result, it is often difficult for a user to hang onto and maintain control of the striking device as the build up of perspiration can result in a significant reduction of friction between the user's hand and the grip of the handle. During use, the handle structure begins to warm up and retain accumulated heat, which further exacerbates the problem. Occasionally, a player or user may find that the combination of heat, perspiration and contact with the handle can result in irritation of the skin of his or her hand. During use of the striking device, the hand, arm and elbow of a user's arm is repeatedly subjected to a jarring shock each time the striking device impacts against an object. The repetitive shock being applied to the user can and often does result in injury to the hand, arm or elbow of the user.

In the prior art, various handle designs have been disclosed with ventilation and shock absorbing features but, for various reasons, none have proved to be particularly successful in practice. For example, U.S. Pat. No. 4,907,810 issued May 13, 1990 to C. L. Whiteford discloses a ventilated and shock absorbing racket handle construction comprised of a rigid tubular shell having a large number of small holes in its surface area and a handle shank mounted in the shell. Air passages are provided between the handle shank and the shell and air can enter these passages through the holes contained in the shell. The shell is wrapped with a leather member also containing a plurality of holes. However, the racket handle in the Whiteford patent relies on random alignment of the holes in the leather wrapping member and the holes in the shank member which often results in few holes in the shell being left open. Furthermore, it is believed that the air passageways and small holes disclosed in the Whiteford patent are not sufficient enough to result in the air flow required to satisfactorily cool a user's hand.

U.S. Pat. No. 5,018,733 issued May 28, 1991 to T. M. M. Buand discloses a handgrip for a racket for ball games that includes a narrow ventilation chamber formed between the body of the handgrip and a sleeve surrounding the grip. However, the outer sleeve is flexible, resulting in the volume of the narrow chamber being varied by the pressure exerted by a player's hand. Again, the construction is such that the airflow in the grip will be insufficient to cool a user's hand or satisfactorily absorb shock.

Therefore, it is an object of the invention to provide a striking device handle which is able to satisfactorily cool and dry a user's hand, and to absorb some of the jarring impact that occurs when an object is hit by the striking device. The handle of the present invention is intended to provide at least some of these desirable features.

In the case of a racket or paddle handle version, it is further an object of the invention to provide a handle that has desirable handling and playing characteristics.

SUMMARY OF THE INVENTION

According to one aspect of the invention, a striking device comprises a head portion for striking an object or surface and a handgrip connected to the head portion. The handgrip is comprised of a central body having concavely curved front and rear surfaces which extend a substantial distance along the handgrip. An exterior shell is disposed on opposite sides of the central body and covers the front and rear surfaces. The shell has a plurality of ventilation openings formed therein that communicate with two separate ventilation chambers that are formed between each of the front and rear surfaces and the shell. Two air inlets are formed on opposite sides of the handgrip at a head end thereof, each air inlet opening into a respective one of the ventilation chambers at the head end. Each ventilation chamber is substantially deeper along a central longitudinal portion than along an end portion that is adjacent a butt end of the handgrip.

In one preferred embodiment, an air passageway extends between the two ventilation chambers near the butt end of the handgrip and the concave surfaces extend longitudinally to points near the butt end of the handgrip.

In another preferred embodiment, the ventilation openings of the striking device such as a racket, are primarily located in a section of the shell extending from the butt end of the handgrip to a transverse plane located about midway between the butt end and the air inlets.

In another preferred embodiment, the exterior shell of the racket or hammer is made as a single integral unit where the air inlets are formed in the integral unit and the integral unit also forms a head section on which the racket strings may be attached or which forms the hammer head or hatchet head.

Preferably an inwardly projecting lip is formed on the shell along one side of each air inlet of the handle. Each lip is preferably formed on the side of its respective air inlet closest to the butt end of the handgrip. The exterior shell of the handle is preferably covered by a flexible, plastic or rubber layer which has perforations aligned with the ventilation openings.

According to another aspect of the invention, a handle assembly for striking devices is provided. The handle assembly comprises a central elongate body having front and rear surfaces which extend generally longitudinally in the handle assembly. A rigid exterior shell extends over the front and rear surfaces and is generally spaced therefrom so as to form two separate ventilation chambers within the shell. The shell is rigidly connected to the elongate body and has a plurality of ventilation openings formed therein. Two air inlets are formed on opposite sides of the handle assembly at a head end of the shell at which a head portion of the striking device can be connected. Each air inlet opens into a respective one of the ventilation chambers at one end thereof. An air passageway is formed in the handle assembly adjacent a butt end of the elongate body, the passageway extending between the ventilation chambers and permitting a restricted amount of air to flow from the other end of each ventilation chamber to the other ventilation chamber during use of the striking device. The amount of airflow is restricted by the small size of the passageway along at least a portion or portions thereof.

According to a further aspect of the invention, a striking device for striking an object or surface has a head portion for striking and a handgrip connected to the head portion. The handgrip is comprised of a central body having front and rear surfaces which extend longitudinally a substantial distance along the handgrip. An exterior shell is disposed on opposite sides of the central body and is connected thereto, the shell having a plurality of small ventilation openings formed therein. At least one elongate ventilation chamber is formed within the shell and is at least partially divided by the central body. Two air inlets, which are substantially larger than the ventilation openings, are formed on respective front and rear sides of the handgrip at a head portion end thereof. The air inlets open into the at least one ventilation chamber so as to allow air to flow into the chamber and out of at least some of the ventilation openings during use of the striking device. Each air inlet lies substantially in a plane that is approximately parallel to a generally flat central section of the front and rear surfaces. Each air inlet has an elongate inwardly projecting lip extending along a side of the inlet closest to a butt end of the handgrip, the lip being provided to reduce the sound caused by the respective air inlet during use of the striking device.

The present invention will be understood and appreciated more fully from the following detailed description, taken in conjunction with the accompanying drawings.

DETAILED DESCRIPTION OF PREFERRED EMBODIMENTS

Figure 1:
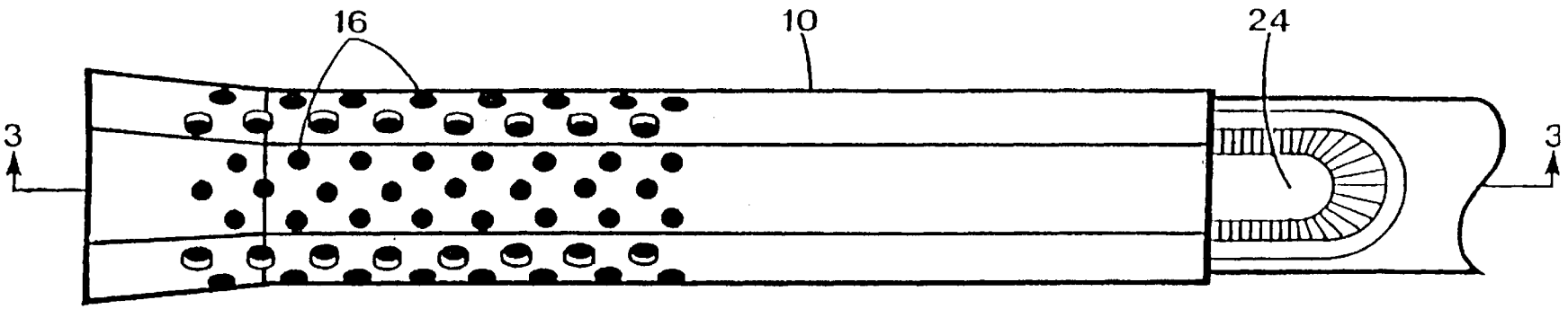
FIG. 1 is a front view of a handle constructed in accordance with the invention.
Figure 2:
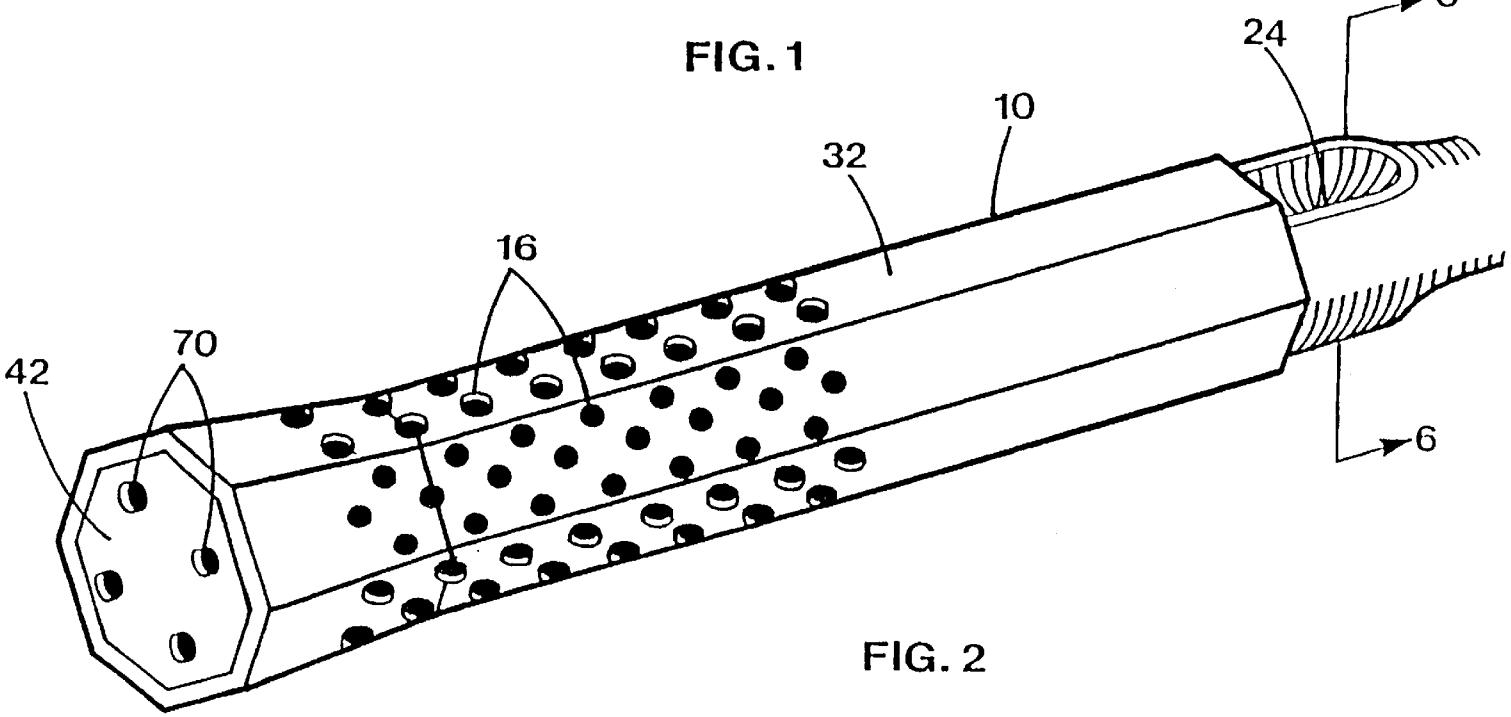
FIG. 2 is a perspective view of the handle of FIG. 1.
Figure 6:
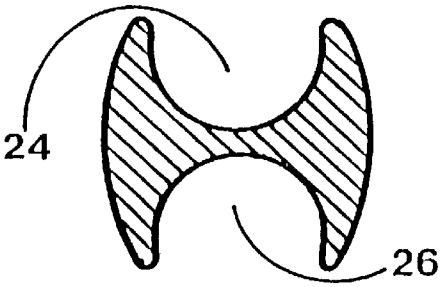
FIG. 6 is a transverse cross-section taken along the line 6—6 of FIG. 2.

Referring firstly to FIGS. 1 to 6, a handle or handgrip 10 on a striking device comprises a central body 12 (see FIG. 3) having concavely curved front 36 and rear 37 surfaces, and an elongate, rigid exterior shell 14. Two separate ventilation chambers 20 and 22 are formed in the handle 10 between the front 36 and rear 37 surfaces of the central body 12 and the exterior shell 14. The chambers 20, 22 extend substantially the length of the handle or handgrip 10. The exterior shell 14 has a plurality of small ventilation holes 16 and 18 formed therein and two relatively large air inlets 24 and 26 are formed on opposite sides of the handgrip. The ventilation holes 16 and 18 and the air inlets 24 and 26 open respectively into the two separate ventilation chambers 20 and 22. The two ventilation chambers 20 and 22 are preferably connected by an air passageway 28 that extends between the two ventilation chambers 20 and 22 near the butt end 42 of the handle. The ventilation holes 16 and 18 are located primarily in the portion of the handle 10 that is normally gripped by a user's hand. In striking devices, such as a tennis racket or hammer, the portion that is generally gripped is the lower section of the hand grip extending from the butt end to about midway between this end and the air inlets 24 and 26.

It will be understood that the present invention can be used for handles for tennis rackets and also for rackets or paddles used in other games such as paddle ball, badminton, squash, racquetball and pingpong and may also be used in other striking devices such as various types of hammers, hatchets, picks and the like. In its broad aspects the handle of the invention can be used in ball or shuttlecock hitting devices used in all racket sports or games, which devices have a generally wide and flat head portion (not shown). For the purposes of this disclosure, the word "ball" is intended to include any type of projectile used in racket sports.

The body of the handle 10 is generally cylindrical, but also could be octagonal, hexagonal, or ovoid in cross-section or a combination thereof, for example. Preferably each of the curved surfaces 36, 37 forms a smooth, substantially continuous curve from its forward end 92 at one side of the air inlet to its rear end 94. Adjacent the ends 92 is a remaining portion 35 which connects to the head of the striking device. The contours of the ends 92 and 94, and of the portion 35 can vary to accommodate a particular air flow intake and a particular striking device head.

Each ventilation chamber is substantially deeper along a central longitudinal portion thereof than along opposite end portions thereof. In the illustrated handle, each surface 36, 37 is more steeply curved at 96 in the vicinity of the air inlet to permit as much air as possible to enter the ventilation chamber and at the same time direct the airflow to move longitudinally through the chamber towards the butt end. Each surface 36, 37 is gently curved at 98 in order to gradually compress the airflow while maintaining the speed and direction of the airflow as much as possible.

Preferably, the exterior shell 14 and the central body 12 are made from a strong, rigid material such as graphite or steel, or a strong, durable composite material including a composite plastics material. The exterior shell 14 preferably is covered by a flexible, plastic, rubber or leather layer or wrap 32 which has perforations aligned with the ventilation openings 16 and 18. The plastic, rubber or leather layer 32 may comprise a strip of material or tubing, similar to that used for grip handles in conventional rackets and other striking devices, that is wrapped or placed around the exterior shell 14 of the handle 10. The use of this material helps to absorb shock when the striking device strikes an object, such as a ball, thus reducing the likelihood of injury to the user's arm and elbow.

Preferably, a curved inwardly projecting lip 30 is formed on the exterior shell 14 on the side of each air inlet 24 and 26 that is closest to the butt end of the handgrip. The lip need not necessarily be curved as shown but can also be square or rectangular in cross-section. The use of the lip 30 helps reduce any sound or sound effect caused by the respective inlet during fast movements of the striking device, which sounds might otherwise be annoying or distracting to some players if the striking device is a racket or paddle intended for a game. The lip is preferably curved as shown as this will result in improved air intake into the inlets 24 and 26 due to the improved aerodynamic flow over a smoothly curved lip.

One preferred form of striking device, such as a racket, is substantially assembled from only two pre-formed molded parts, one part being comprised of a major portion of the central body 12 that is a wedge shape member 34 (see FIG. 5), the other part being comprised of the exterior shell 14 (see FIG. 3), the remaining portion 35 of the central body 12, and the head portion, on which, in the case of a racket, the usual racket strings are mounted. The wedge shaped member 34 has curved front 36 and rear 37 surfaces and two opposite sides that each have an elongate ridge 38 extending lengthwise along the length of the wedge-shaped member 34. Preferably each ridge 38 has a triangular cross-section as shown. The two ridges 38 of the wedge-shaped member 34 are each received in a respective groove 40, 41 that is formed in the exterior shell 14, thereby connecting the exterior shell 14 and the wedge shaped member 34 together. Adhesive and/or mechanical fasteners can also be used to strengthen the connection between the body and the shell, if desired. The end of the wedge shaped member 34 closest to the head end of the racket or other striking device has a double curved edge 44 that is received by a corresponding edge 46 of the portion 35 of the central body 12 (see FIG. 3). The wedge shaped portion 34 includes a butt plate 42 which covers the air passageway 28 between the ventilation chambers 20 and 22. The shape of butt plate 42 corresponds to the shape of the body of the handle 10 in the preferred embodiment. The cross-sectional area of the air passageway 28 is substantially less than the average cross-sectional area of the ventilation chambers 20 and 22. Two flat, integral spacers 72 are formed at the rear of the member 34 in order to form the air passageway 28.

Although the exterior shell 14 and portion 35 can be manufactured as a single integral unit that also includes the head of the striking device (such as a racket), it is also possible to make these components separately and to connect them together in a strong rigid manner. It will be appreciated that the illustrated two piece construction of the handle provides for a durable and strong striking device structure that is relatively easy to manufacture and assemble.

The exterior shell 14 and the portion 35 can also be manufactured from materials such as steel, other metals, or durable composites. A metal exterior shell would be much heavier than a shell made from graphite or a plastic composite. Also, a metal shell could be thinner, and would be more durable and less flexible than a non-metal shell made of graphite or a plastic composite.

In a metal embodiment, the exterior shell 14 and the portion 35 can be cast from hot metals as a single unit. Alternatively the two portions can be drop forged. They can be mechanically attached or welded together to form the whole striking device.

In a preferred manufacturing process according to drop forging, the portion 35, the central body 12 and the wedge shaped member 34 are forged out of a single piece of metal. As a result of this process, no corresponding edge 46 would exist. Further according to this manufacturing process, a tubular sleeve of steel or strong composite plastic (pre-drilled with the ventilation holes) is slid on top of the forging. A firm connection between the sleeve and the forged piece is achieved by either welds or pressurized mechanical methods. A nylon or rubber overgrip can be pre-placed, cast onto or added later to form the whole device.

In operation, the handle 10 of the present invention cools and reduces perspiration from the hand of a user and absorbs some of the shock that occurs when an object, such as a ball, is hit by the striking device. Referring to the figures, when the handle 10 is swung in a forward motion, air is forced through the air inlet 24 into the ventilation chamber 20. As the air flows through the ventilation chamber 20 towards the butt-end of the handle 10, the depth and the cross-sectional area of the ventilation chamber 20 decrease, thus resulting in increased air pressure towards the butt end. The air pressure in the chamber causes a certain amount of air to flow through at least some of the ventilation holes 16 which are located in the front surface-of the exterior shell 14 of the racket handle 10, particularly those holes not covered by a user's hand. Preferably, an air passageway 28 permits a restricted amount of the air flowing through the ventilation chamber 20 to pass or be drawn through the butt-end into the ventilation chamber 22. Once the air flows into ventilation chamber 22, some of it exits through the ventilation holes 18 which are located in the rear surface of the shell 14. Additionally, some of the air will flow out through the air inlet 26 on the rear of the shell 14.

It will be understood that by swinging the handle 10 in a forward direction, positive air pressure is applied at air inlet 24 and negative air pressure or suction is created at air inlet 26 and ventilation holes 18, thus providing the force necessary to move the air through the handle 10 in the manner described above. It will further be appreciated that the airflow direction described above will generally be reversed when the racket or other striking device is swung in a backwards direction. During a back swing, the air will flow into the ventilation chamber 22 via the air inlet 26, then some will flow out through the air outlets 18 and a restricted amount will flow through the air passageway 28 into the ventilation chamber 20 and finally out of the air inlet 24.

During each forward swing and back swing of the handle, a flow of air is forced through some of the ventilation holes 16 and 18 thereby providing a cool flow of fresh air on the hand of the user that is gripping the handle 10. During a forward swing, a greater amount of air exits through the ventilation holes 16 and during a back swing, a greater amount of air exits through the ventilation holes 18. As a result, the user's hand is cooled and perspiration from the user's hand is both reduced and removed, thereby allowing the user to have an increased control over the striking device (including a racket or paddle) and avoiding irritation to the skin surface of his or her hand. The flow of air through the handle during each swing also acts to cool and reduce thermal build-up in the handle 10 itself.

Additionally, the flow of air from the ventilation chambers 20 and 22 out through the holes 16 or 18 is believed to create a thin cushion of air between the outer layer 32 and the user's hand, which cushions the vibrations and oscillations that occur in the handle 10 when an object, such as a ball, is hit by the striking device. The cushioning effect of the air that is flowing out of the handle 10 may help to reduce incidents of injury and strain that may occur in a user's hand and arm during use of the striking device, for example, during racket sports if the device is a racket or during construction work if the device is a hammer.

Figure 8:
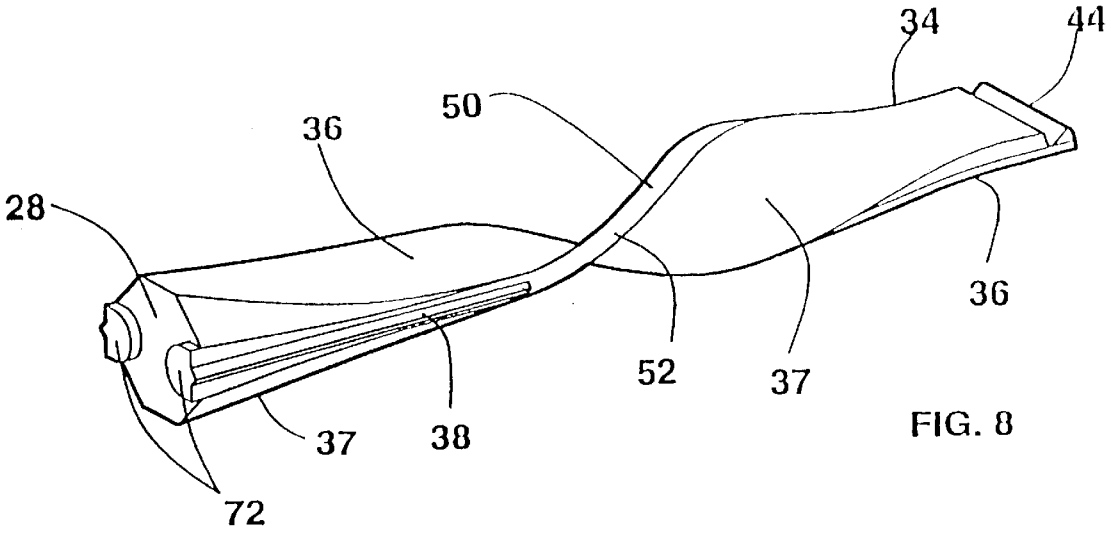
FIG. 8 is a perspective view of the central body of the embodiment shown in FIG. 7.
Figure 7:
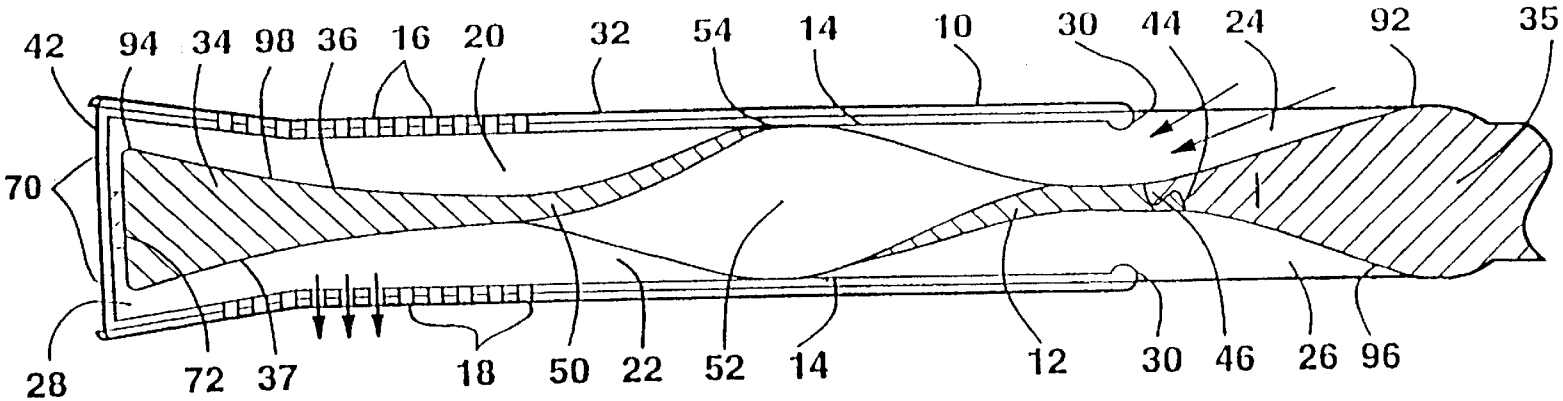
FIG. 7 is a cross-sectional view similar to FIG. 3, but showing another preferred embodiment of the invention.

Referring next to FIGS. 7 and 8, another embodiment of handgrip 10 is shown having a modified central body 50.

Central body 50 has a 180 degree centre twist 52 formed therein between the ventilation openings 16,18 and air inlets 24, 26, or about half way along exterior shell 14. Front and rear surfaces 36,37 and ventilation chambers 20, 22 are thus reversed by this centre twist 52. In this way air entering inlet 24 rolls in a spiral fashion to exit primarily through ventilation holes 18 located on the rear surface of exterior shell 14. Some of the air again passes through air passageway 28 to exit through ventilation holes 16. This air flow is reversed, of course, on the back swing, as is the case with the embodiment shown in FIGS. 3 and 5.

Central body 50 has shortened elongate ribs 38 and is of a width such that a snug fit is provided at 54 between the peripheral edges of central body 50 and the inside surfaces of exterior shell 14. Of course, the transverse shape of central body 50 is formed to correspond with the inside configuration of shell 14, be it hexagonal or circular, to ensure that air flow passes longitudinally through ventilation chambers 20,22 and is not bypassed around the peripheral edges of central body 50. Otherwise, the embodiment shown in FIGS. 7 and 8 is substantially the same as the embodiment shown in FIGS. 3 and 5, and central body 50 is still considered to have concavely curved front and rear surfaces even though they are reversed halfway along their length.

Referring to all of the above-mentioned preferred embodiments of the invention, it will be appreciated that the ventilation chambers 20 and 22 and the air inlets 24 and 26, together with the ventilation holes 16 and 18 are dimensioned to allow an optimal amount of fresh air to flow through the handle 10 and out of the ventilation holes 16 and 18, while at the same time providing for a strong and durable striking device construction. A person who is skilled in the art will appreciate that varying the depth and thus the cross-section of the ventilation chambers 20 and 22 provides for an efficient means of forcing air through the ventilation holes 16 and 18 when the handle 10 is swung. Further, the large, open air inlets 24 and 26 provide efficient devices for scooping outside air into the ventilation chambers. In addition, the swinging action of the striking device results in fresh air being compressed to some extent as it passes through the ventilation chamber. As compressed air is naturally cooler, this fact will also act to cool the shell and the outer cover.

Because of the possibility of water entering the hollow handle during use of the striking device, particularly in wet weather, it is desirable to provide drainage holes 70 for the water to drain out. Four small holes 70 can be formed in the corners of the butt plate 42 for this purpose. These holes can be located adjacent the passageway 28.

Although the holes 16 and 18 as illustrated are round clearly they can have other shapes including square and rectangular. They should not be so numerous or so big as to weaken the strength and rigidity of the shell or to lessen its ability to support the flexible outer wrap or cover 32.

Figure 9:
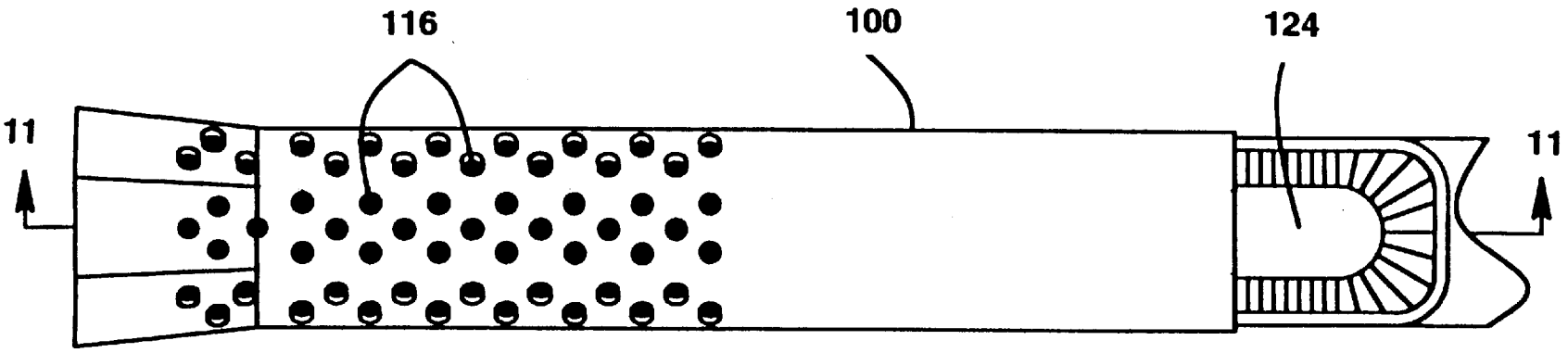
FIG. 9 is a front view of another handle embodiment constructed in accordance with the invention and having an ovoid shape in cross-section.
Figure 10:
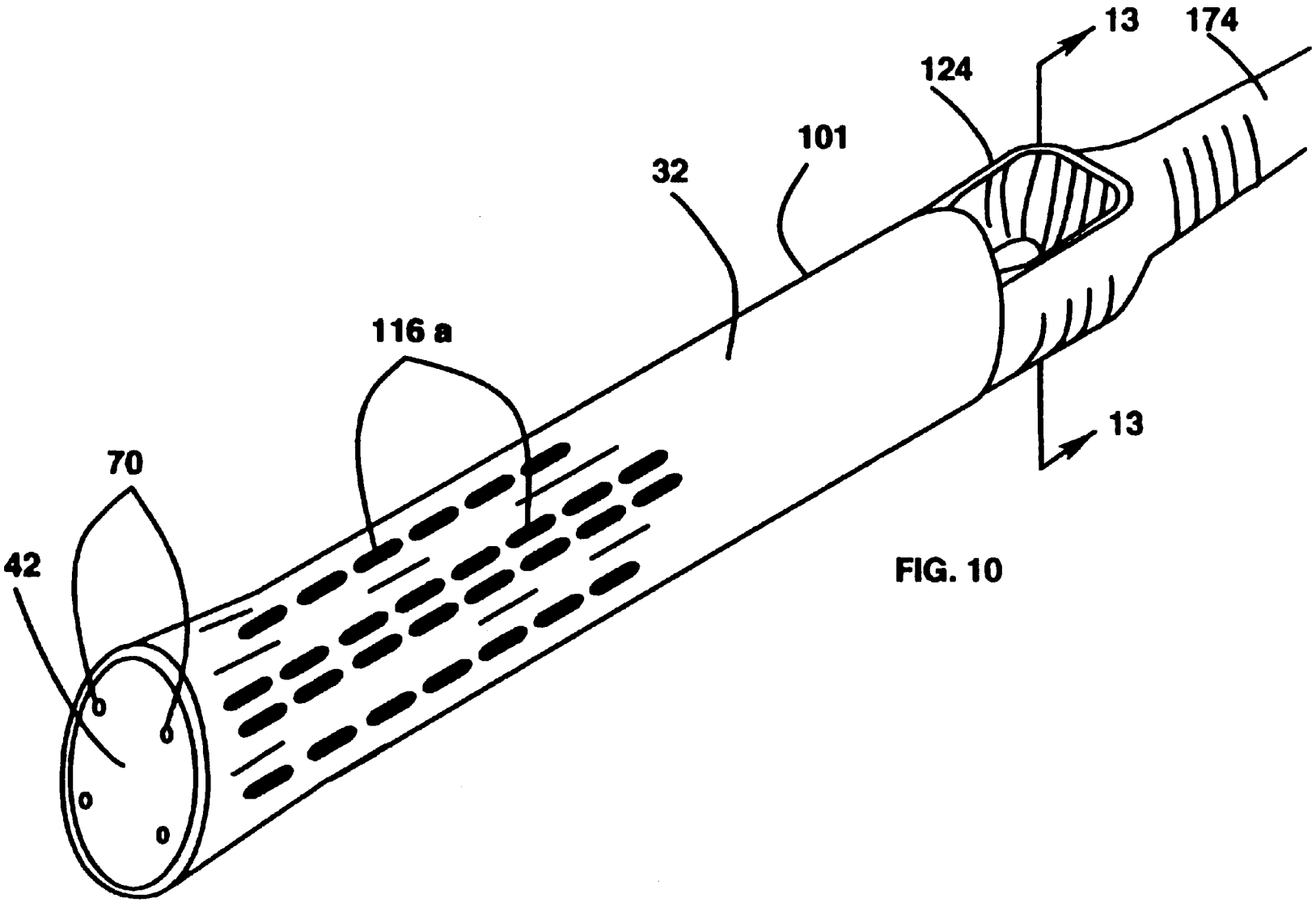
FIG. 10 is a perspective of yet another handle, similar in most respects to the handle of FIG. 9 and having an ovoid shape in cross-section.
Figure 12:
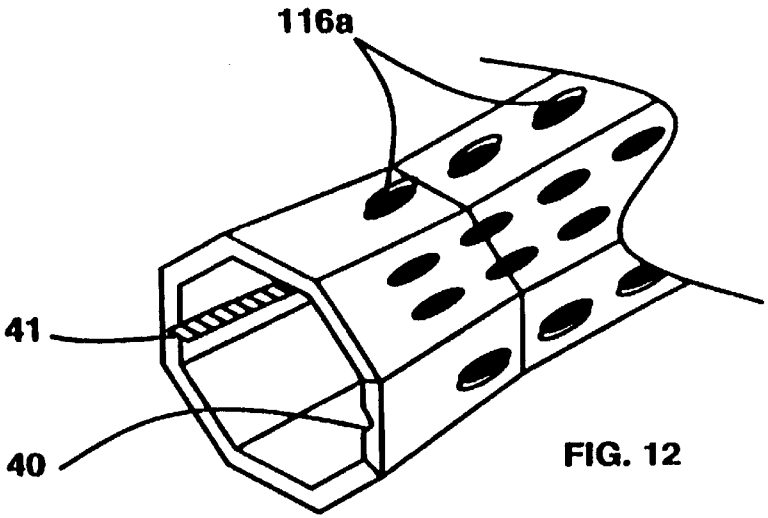
FIG. 12 is a perspective view of a butt end section of another version of the exterior shell, utilizing another type of hole pattern that can be used with the handle of the invention.

The handle of the present invention can also be used as a handle for various striking devices such as hammers, hatchets, axes or picks. Alternate forms of handles 100 and 101 that are particularly suitable for use on a hammer or axe are shown in FIGS. 9 and 10. These alternate handles 100 and 101 are generally round in transverse cross-section rather than being flat sided as is the case with the first embodiment in FIGS. 1 and 2. The handle 100 also has a number of small round ventilation holes 116 which can generally be arranged on the lower half of the handle adjacent the butt end. The handle 101 has holes 116*a* arranged in a similar manner but its holes are elongate in the longitudinal direction. Each handle also has two air inlets 124 and 126 which are square in shape and of increased size as compared to the openings 24, 26. Thus, in the handle 100, 101, the openings 124 and 126 provide a larger air intake at the head end of the handle, permitting a greater amount of air to pass into the ventilation chambers. The preferred handle shape of the embodiments shown in FIGS. 9 and 10 is one with a generally ovoid or elliptical cross-section as indicated by the butt end of the handle shown in FIG. 10. It will be appreciated that this shape corresponds to that used in many standard handles for hammers and hatchets yet the handle 100, 101 still provides the advantages of the present invention. Elongate holes 116*a* are shown on the rigid shell itself in FIG. 12.

Figure 11:
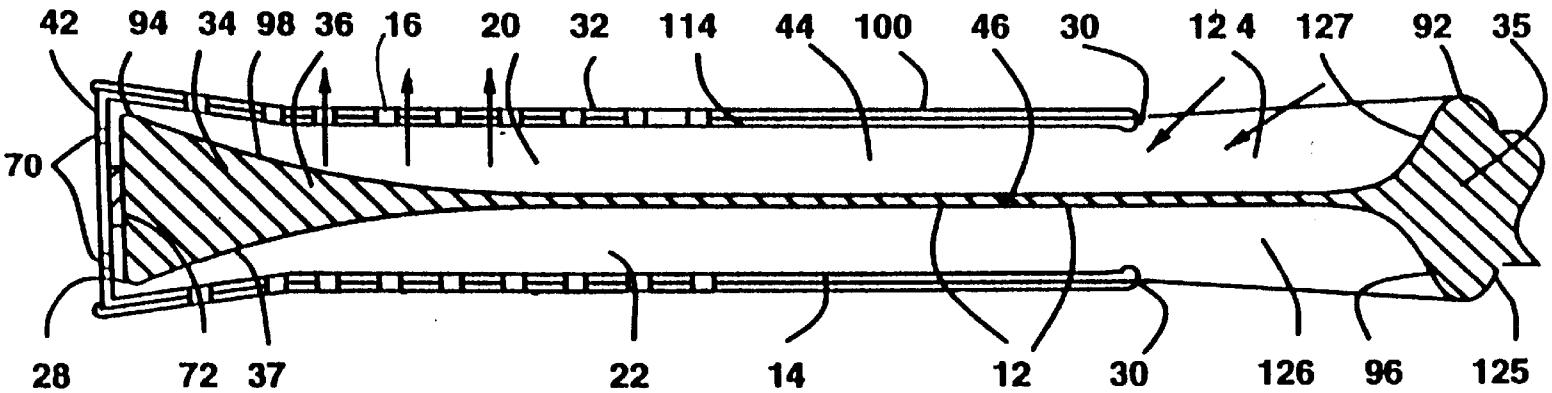
FIG. 11 is a cross-sectional view of the handle taken along the line 11—11 of FIG. 9 and having an ovoid shape in cross-section.

The embodiment of FIGS. 9 to 11 still has two separate ventilation chambers 20 and 22 that are formed between the exterior shell 114 and front and rear surfaces of the central body 12. The chambers 20 and 22 extend substantially the length of the handle or handgrip 100. Again, the two ventilation chambers are preferably connected by an air passageway 28 that extends between these chambers near the butt end 42 of the handle.

Figure 3:
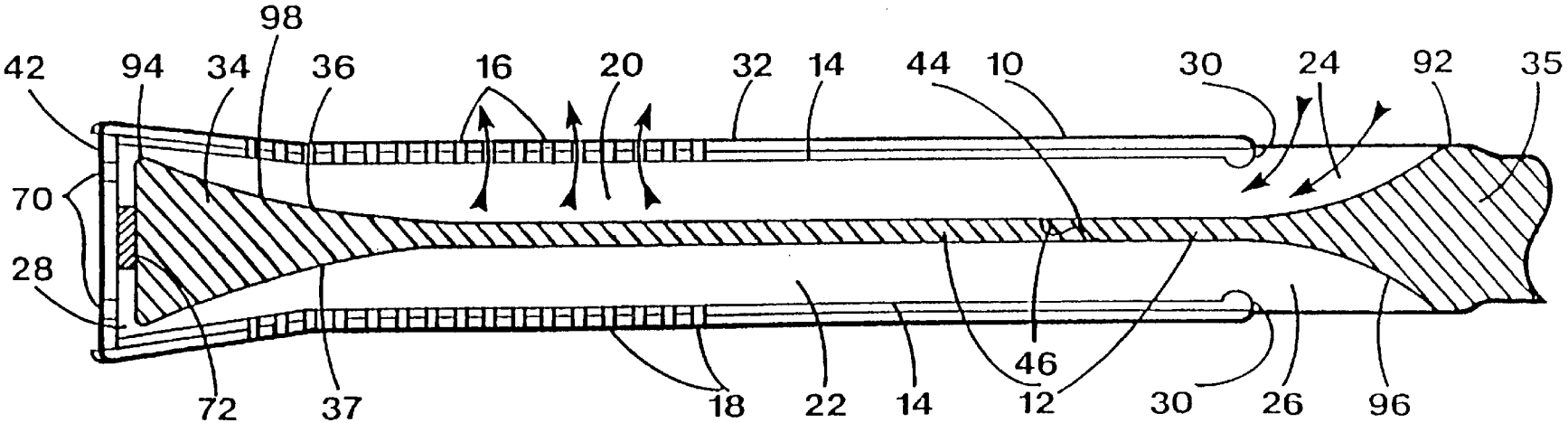
FIG. 3 is a cross-sectional view of the handle, taken substantially along the line 3—3 in FIG. 1.
Figure 4:
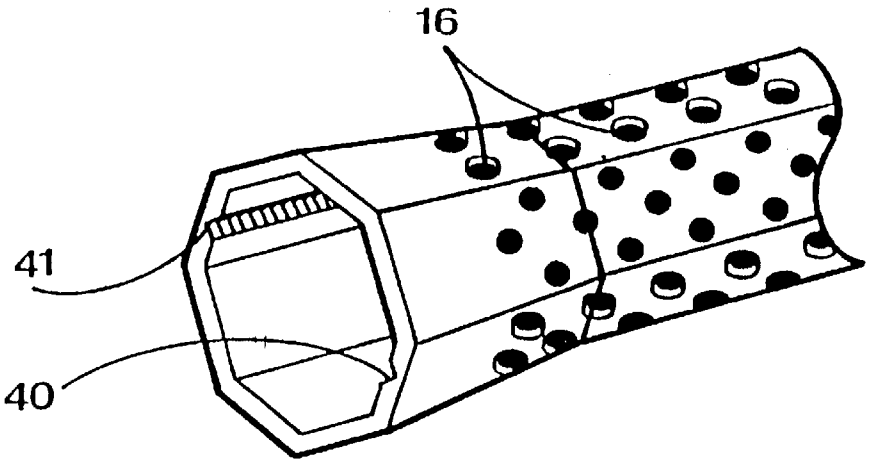
FIG. 4 is a perspective view of a lower half or butt end half of the exterior shell only without its flexible covering and with a butt end plate and central body removed.
Figure 5:
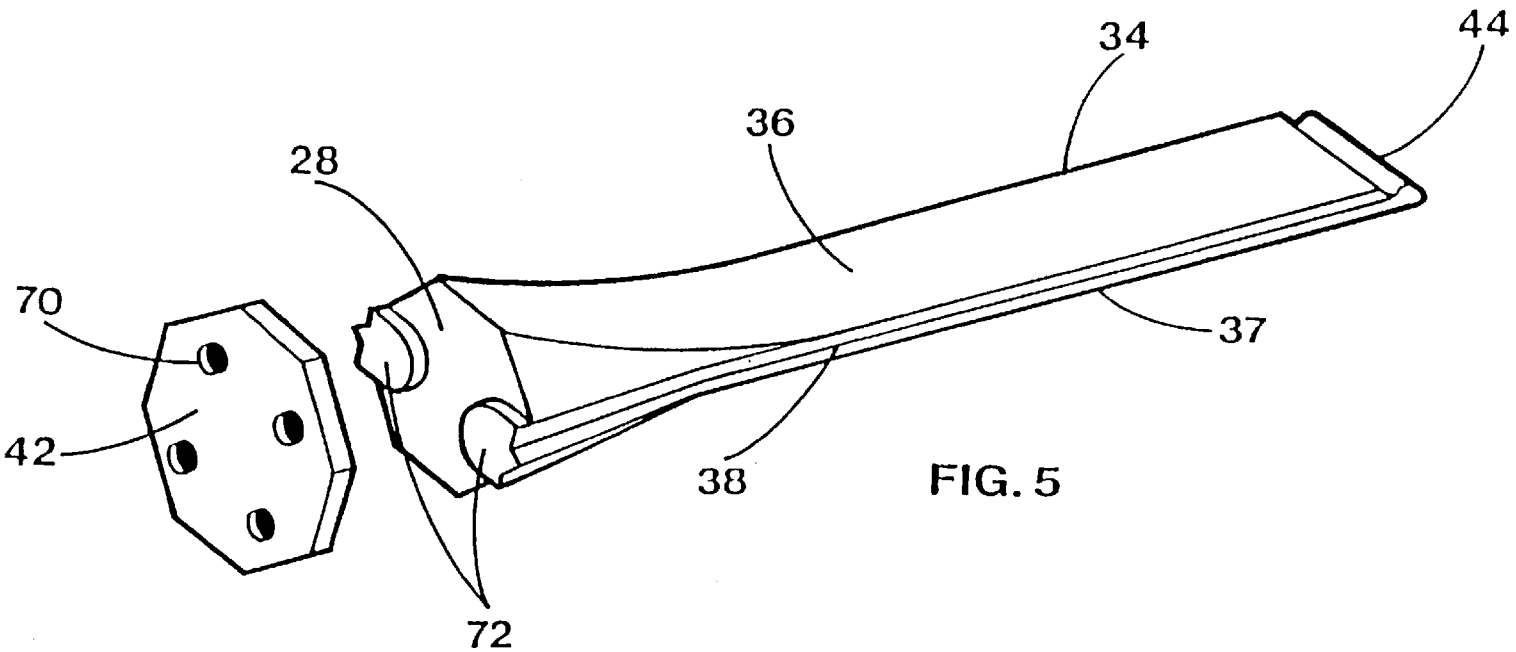
FIG. 5 is a perspective view of a major portion of the central body of one preferred form of handle with the butt end plate moved outwardly to show passageways near the butt end of the handle.

Compared to the embodiment of FIG. 3, a larger ridge 125 is formed around each of the openings 124 and 126, particularly on the side closest to the head portion of the striking device. It will also be seen that the air inlet surface at 127 is more steeply inclined in this handle version, extending at an angle of at least 45 degrees to a central plane that is parallel to the central section of the central body 12.

The exterior shell 114, which can be made of a metal such as steel in the case of a handle for a hammer or an axe, is preferably covered by a flexible, rubber or plastic tube, layer or wrap 32 which has its perforations aligned with the ventilation openings 16.

As in the first embodiment, the wedge shaped member 34 of the central body can be made with an elongate ridge extending lengthwise along its length and having a triangular cross-section. These ridges are received in respective grooves 40 and 41 that are formed in the exterior shell 114 to connect these members together.

Figure 13:
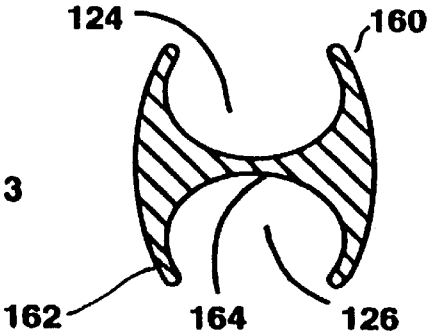
FIG. 13 is a transverse cross-section taken along the line 13—13 of FIG. 10.

FIG. 13 illustrates by means of a cross-section through the air inlets how the central body forming these inlets can be made slimmer and thinner in some regions if strong durable materials such as a metal is used in the construction of the striking device. In particular, the ridge sections at 160 and 162 can be made thinner (compare these ridges to those shown in FIG. 6) and the bottom at 164 forming the bottom of the air inlet can be thinner. It will be appreciated that this thinness can extend down the length of the handle and can result in larger ventilation chambers.

Figure 15:
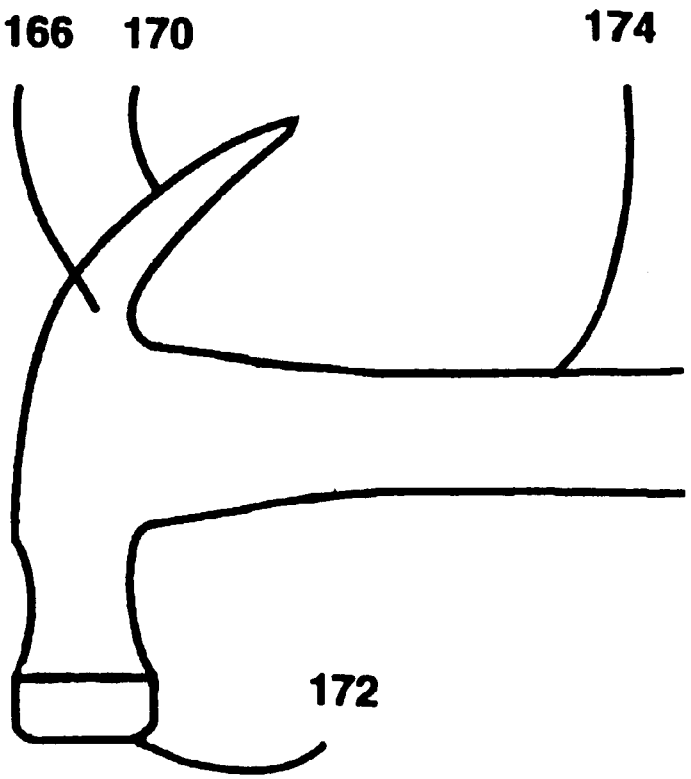
FIG. 15 is a side view of a hammer head that can be connected to the handle of the invention.
Figure 16:
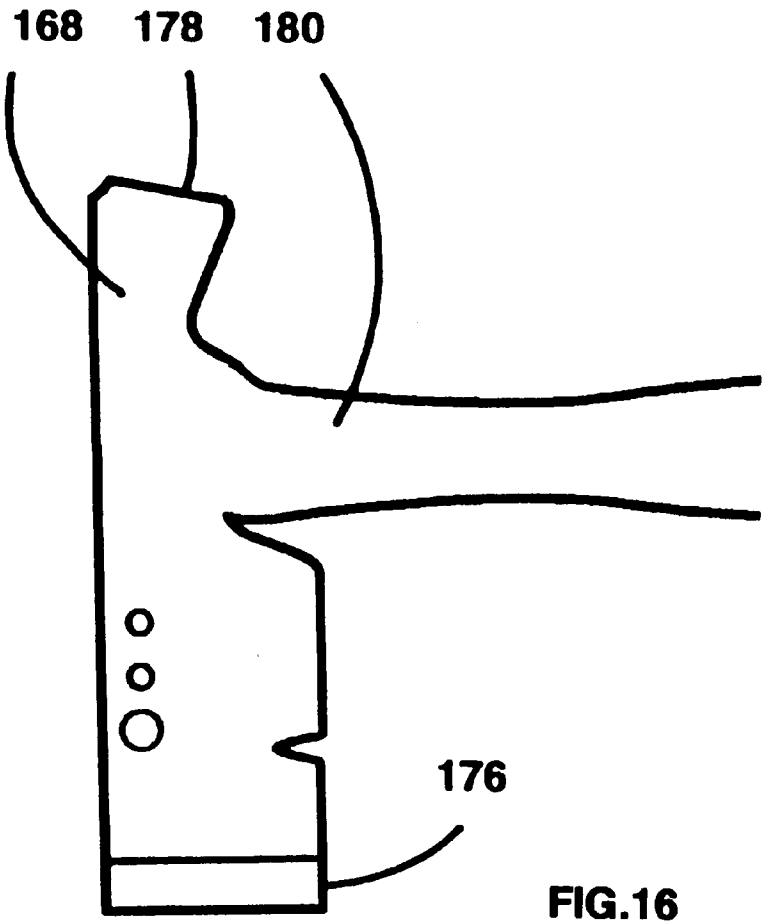
FIG. 16 is a side view of a hatchet head that can be connected to the handle of the invention.

Turning to FIGS. 15 and 16 of the drawings, these figures show a hammer head 166 and a hatchet head 168, both of which can be made of a strong material such as steel. Both the hammer head 166 and the hatchet head 168 can be of standard construction per se. For example, the hammer can, if desired, be provided with standard claws at 170 and a circular striking head at 172. The steel head can be connected to a steel solid or hollow connecting shank 174 which is also indicated on the right side of FIG. 10. In the case of the hatchet head, it can have a sharp blade at 176 and opposite the blade can be a rectangular flat end 178. The particular configuration of the axe or hatchet head as is well known will vary depending upon its dual intended purpose and whether or not it is a large axe or a smaller hatchet. Again, the hatchet head is connected to an elongate, solid or tubular connecting shank 180. It will be appreciated that in either case when the handle of the invention is used to construct either a hammer or a hatchet, the hammer head 166 or the hatchet head 168 comprises the head portion of the striking device.

Figure 14:
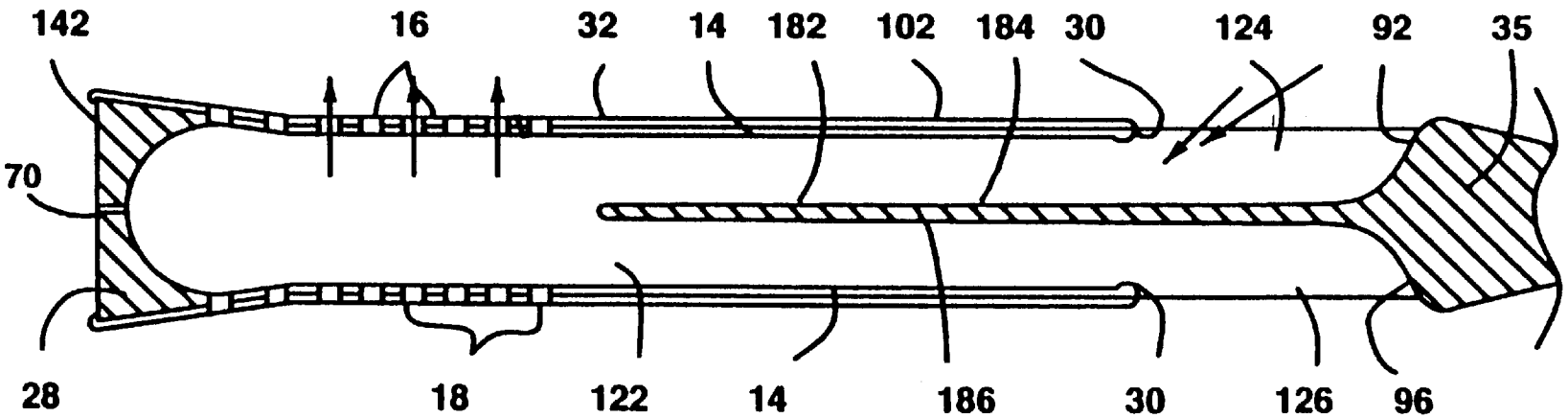
FIG. 14 is a longitudinal cross-section similar to FIG. 3 but showing a further embodiment of the invention.

Turning now to the further embodiment of the handle of the invention shown in FIG. 14, this embodiment is indicated by reference 102. The handle 102 has an elongate rigid exterior shell 14 that-can be constructed in substantially the same manner as the embodiments described previously. However, in this embodiment there is only a single ventilation chamber 122 that extends substantially the entire length of the handle. Located centrally within this ventilation chamber is a central body 182 that is formed as a single piece and that acts as a dividing member having front and rear surfaces indicated at 184 and 186. These surfaces extend a substantial distance along the handgrip from a head end thereof located closest to the head portion of the striking device towards a butt end 142. The exterior shell 14 is disposed around this central dividing member 182 and covers at least a major portion of its front and rear surfaces. As illustrated, the front and rear surfaces are partially exposed of course at the air inlets 124 and 126. In this embodiment, a substantial portion only of the single ventilation chamber 122 is divided by the dividing member. The air inlet openings 124 and 126 open into this substantial divided portion of the ventilation chamber located at the head end thereof. With this version, the incoming air is forced to flow downwardly into the handle and then near the butt end of the handle the air can exit on either side of the handle through the openings 16 or 18. The air flows out of the openings 16 or 18 simply as a result of greater air pressure being created within the handle than exists outside of the handle assembly. This embodiment has the advantage that the centre body acts to direct the captured air towards the openings 16 and 18, thereby actively cooling both the palm and the fingers of the user at the same time.

It will be appreciated by persons skilled in the art that the present invention is not limited by what has been particularly shown and described herein. Rather, the scope of the present invention is defined only by the claims which follow.

I therefore claim:

1. A striking device comprising a head portion for striking an object or surface and a handgrip connected to said head portion, said handgrip including:

a central body having concavely curved front and rear surfaces which extend longitudinally a substantial distance along said handgrip;

an exterior shell disposed on opposite sides of said central body and covering said front and rear surfaces, said shell having a plurality of ventilation openings formed therein and communicating with two separate ventilation chambers formed between each of said front and rear surfaces and said shell; and two air inlets formed on opposite sides of said handgrip at a head end thereof, each air inlet opening into a respective one of said ventilation chambers at a head end thereof;

wherein each ventilation chamber is substantially deeper along a central longitudinal portion thereof than along an end portion thereof adjacent to a butt end of the handgrip.

2. A striking device according to claim 1 wherein an air passageway extends between said two ventilation chambers near said butt end of the handgrip and said concavely curved surfaces extend longitudinally to points near said butt end of the handgrip.

3. A striking device according to claim 2 wherein said exterior shell is substantially covered by a flexible, resilient plastic or rubber layer which has perforations aligned with said ventilation openings.

4. A striking device according to claim 1 wherein said ventilation openings are primarily located in a section of said shell extending front said butt end of the handgrip to a transverse plane located about midway between said butt end and said air inlets.

5. A striking device according to claim 1 wherein said exterior shell is made as a single integral unit, said air inlets being formed in said integral unit, and wherein said integral unit also forms said head portion which is used for striking.

6. A striking device according to claim 1 wherein a major portion of said central body comprises a wedge-shaped member having curved front and rear surfaces and two opposite sides extending between these front and rear surfaces, said opposite sides each having an elongate ridge extending lengthwise of said central body and wherein said exterior shell has two elongate grooves formed in opposite sidewalls thereof, each ridge being received in a respective one of said grooves in order to connect said wedge-shaped member to said shell.

7. A striking device according to claim 1 wherein said striking device is a hammer and said head portion includes a hammer head.

8. Striking device according to claim 7 wherein said exterior shell is substantially tubular in shape.

9. A striking device according to claim 7 wherein said central body and said exterior shell are made at least primarily of steel.

10. Striking device according to claim 7 wherein said head portion and said central body are formed integrally in one metal piece.

11. A striking device according to claim 1 wherein said striking device is a hatchet and said head portion includes a hatchet head.

12. Striking device according to claim 1 wherein the central body has a 180 degree centre twist formed therein between the ventilation opening and the air inlets, so that said front and rear surfaces and said ventilation chambers are reversed by said centre twist.

13. Striking device according to claim 12 wherein said 180 degree centre twist is located generally halfway along the exterior shell.

14. A handle assembly for a striking device, said handle assembly comprising:

a central elongate body having front and rear surfaces which extend generally longitudinally in the handle assembly;

a rigid exterior shell extending over said front and rear surfaces and generally spaced therefrom so as to form two separate ventilation chambers within the shell, said shell being rigidly connected to said elongate body and having a plurality of ventilation openings formed therein;

two air inlets formed on opposite sides of said handle assembly at a head end of said shell at which a head portion of said striking device can be connected, each air inlet opening into a respective one of said ventilation chambers at one end thereof; and an air passageway formed in said handle assembly adjacent a butt end of said elongate body, said passageway extending between said ventilation chambers and permitting a restricted amount of air to flow from the other end of each ventilation chamber to the other ventilation chamber during use of said striking device, the amount of air flow being restricted by the small size of said passageway along at least a portion or portions thereof;

wherein said front and rear surfaces each curve outwardly to a point close to said exterior shell at said butt end, at least one entry to said air passageway being formed by a gap between said elongate body and said exterior shell at said butt end.

15. A handle assembly according to claim 14 wherein the central elongate body has a 180 degree centre twist formed therein, between the ventilation openings and the air inlets, so that said front and rear surfaces and said ventilation chambers are reversed by said centre twist.

16. A handle assembly according to claim 15 wherein said 180 degree centre twist is located generally halfway along the rigid exterior shell.

17. A handle assembly according to claim 14 wherein said front and rear surfaces each curve outwardly to a head portion side of a respective air inlet.

18. A handle assembly according to claim 14 wherein said ventilation openings are primarily located in a section of said shell extending from a transverse plane at said butt end to a transverse plane located about midway between said butt end and said air inlets.

19. A hammer comprising a hammer head portion adapted for striking an object and a handle assembly according to claim 14, wherein said hammer head portion is rigidly connected to said handle assembly at an end thereof opposite said butt end.

20. A hammer according to claim 19 wherein both said hammer head portion and said central elongate body are made of steel or durable composite material and are integrally formed as one piece.

21. A hatchet comprising a hatchet head with a blade and a handle assembly according to claim 14 wherein said hatchet head is rigidly connected to said handle assembly at an end thereof opposite said butt end.

22. Striking device for striking an object or surface, said device comprising:

a head portion adapted for striking said object or surface;

an elongate shaft portion rigidly connected to said head portion; and a handgrip rigidly connected to said shaft portion, said handgrip including a fixed central dividing member having front and rear surfaces which extend longitudinally a substantial distance along said handgrip from a head end thereof located closest to said head portion towards a butt end of said handgrip, an exterior shell disposed around said central dividing member and covering at least a major portion of said front and rear surfaces, said shell having a plurality of ventilation openings formed therein and communicating with a ventilating chamber formed by said shell, a substantial portion only of said ventilation chamber being divided by said dividing member, and two air inlets formed on opposite sides of said handgrip at said head end thereof, each air inlet opening into said substantial portion of said ventilation chamber at said head end of the ventilation chamber, wherein said air inlets are substantially larger than said ventilation openings and said shaft portion is substantially solid with no longitudinal passageway formed therein.

23. A striking device according to claim 22 wherein said striking device is a hammer and said head portion is a hammer head.

24. A striking device according to claim 23 wherein said shaft portion, said central dividing member, and said shell are made of steel or a durable, strong composite material and said shell is generally tubular.

25. Striking device according to claim 22 wherein said striking device is a hatchet and said head portion is a hatchet head with a blade.

26. A striking device for striking an object or surface, said device having a head portion for striking and a handgrip connected to said head portion, said handgrip comprising:

a central body having front and rear surfaces which extend longitudinally a substantial distance along said handgrip;

an exterior shell disposed on opposite sides of said central body and connected thereto, said shell having a plurality of small ventilation openings formed therein;

at least one elongate ventilation chamber formed within said shell and at least partially divided by the central body; and two large air inlets, which are substantially larger than said ventilation openings, formed on respective front and rear sides of said handgrip at a head portion end thereof, the air inlets opening into said at least one ventilation chamber so as to allow air to flow into the chamber and out of at least some of said ventilation openings during use of said striking device, and each air inlet lying substantially in a plane that is approximately parallel to generally flat central longitudinal sections of said front and rear surfaces;

wherein each air inlet has an elongate, inwardly projecting lip extending along a side of the inlet closest to a butt end of the handgrip, said lip being provided to reduce any sound caused by the respective air inlet during use of said striking device.

27. A striking device according to claim 26 wherein each lip is formed on said exterior shell and projects inwardly from an adjacent inner surface of said exterior shell.

28. Striking device according to claim 27 wherein each lip is curved as viewed in a transverse cross-section of the lip so as to have a smoothly rounded exterior.

29. A striking device according to claim 26 wherein said exterior shell is made of a strong, relatively rigid, metal or a strong, durable composite material and said shell is substantially covered by a flexible, plastic or rubber layer which has perforations aligned with said ventilation openings.

* * * * *